US008784086B2

(12) United States Patent
Smith et al.

(10) Patent No.: US 8,784,086 B2
(45) Date of Patent: Jul. 22, 2014

(54) ROTARY PISTON STEAM ENGINE WITH ROTARY VARIABLE INLET-CUT-OFF VALVE

(76) Inventors: Errol John Smith, Sydney (AU); Kenneth Murray Smith, Wyee (AU)

( * ) Notice: Subject to any disclaimer, the term of this patent is extended or adjusted under 35 U.S.C. 154(b) by 50 days.

(21) Appl. No.: 13/266,427

(22) PCT Filed: Jun. 8, 2010

(86) PCT No.: PCT/AU2010/000706

§ 371 (c)(1),
(2), (4) Date: Oct. 26, 2011

(87) PCT Pub. No.: WO2010/132960

PCT Pub. Date: Nov. 25, 2010

(65) Prior Publication Data

US 2012/0039733 A1 Feb. 16, 2012

(51) Int. Cl.

| | |
|---|---|
| ***F01C 1/18*** | (2006.01) |
| ***F03C 2/00*** | (2006.01) |
| ***F03C 4/00*** | (2006.01) |
| ***F04C 2/00*** | (2006.01) |

(52) U.S. Cl.
USPC ..... 418/206.1; 418/15; 418/104; 418/206.6; 418/270

(58) Field of Classification Search
USPC ..... 418/9, 15, 104, 206.1–206.8, 270
See application file for complete search history.

(56) References Cited

U.S. PATENT DOCUMENTS

| | | | | |
|---|---|---|---|---|
| 630,124 | A | 8/1899 | Stage | |
| 773,401 | A * | 10/1904 | Leibenguth | 418/206.1 |
| 2,138,050 | A * | 11/1938 | Vickers | 418/206.1 |
| 2,228,933 | A * | 1/1941 | Thomson | 418/206.4 |
| 3,275,226 | A * | 9/1966 | Whitfield | 418/203 |
| 3,628,893 | A * | 12/1971 | Carpigiani | 418/15 |
| 3,723,031 | A * | 3/1973 | Brown | 418/15 |
| 4,867,659 | A * | 9/1989 | Eiermann et al. | 418/142 |
| 6,302,079 | B1 | 10/2001 | Beal | |
| 6,913,452 | B2 * | 7/2005 | Heizer | 418/201.1 |

FOREIGN PATENT DOCUMENTS

| | | | |
|---|---|---|---|
| GB | 122827 | A | 5/1919 |
| WO | WO 2006/102696 | A1 | 10/2006 |

OTHER PUBLICATIONS

International Search Report, Jul. 30, 2010, from International Phase of the instant application.

* cited by examiner

*Primary Examiner* — Theresa Trieu
(74) *Attorney, Agent, or Firm* — Jackson Patent Law Office

(57) ABSTRACT

Rotary piston steam engine with equal double rotary pistons is provided with a balanced rotary variable inlet cut-off valve for enhanced efficiency. The exhaust steam from the primary expansion is routed to secondary expansion avoiding back pressure for additional efficiency. The rotary valve has balanced dual inputs and outputs on opposite sides. The exhaust steam from the primary expansion is taken off when the trailing face of the rotary piston passes the inlet port of the expansion chamber housing, the exhaust outlet secondary expansion being placed approximately 180 degrees from the primary expansion inlet in the curved portion of the expansion chamber housing wherein back pressure is not imparted to the primary expansion.

11 Claims, 11 Drawing Sheets

ROTARY PISTON STEAM ENGINE WITH ROTARY VARIABLE INLET-CUT-OFF VALVE

BACKGROUND OF THE INVENTION

1. Field of the Invention

This invention relates generally engines and, more particularly, to rotary piston steam engine with balanced rotary variable inlet-cut-off valve and secondary expansion without back-pressure on primary expansion.

2. Description of Related Art

The "equal double rotary piston" mechanism was patented in France in 1832 but its potential has never been fully realised because of various problems which are now solved with a balanced rotary variable inlet cut-off valve and secondary expansion driven by the exhaust of the primary expansion in a manner which does not impart back-pressure against the primary expansion.

FIG. 1 teaches the basic geometry of the "equal double rotary piston" mechanism. There are two equal disc-like rotary pistons mounted on parallel shafts and housed within an expansion chamber closely fitted around the path traced by raised semicircular portions of the rotary pistons. The raised semicircular surface of one rotary piston 1 and the non-raised semicircular surfaces of the other rotary piston 54 have a close approach at the central point of the expansion chamber. The piston "faces" between the raised and non raised portion of the rotary pistons are of a suitable gear tooth profile. The top of the raised cam-like portion of the rotary piston extends nearly 180°, this long distance providing good sealing despite absence of piston rings. The two rotary pistons 1 and 2 are secured on two parallel drive shafts 10 and 20, each shaft being secured to a geared wheel 12, 22 external to the expansion chamber. These two equal gear wheels engage and turn the rotary pistons in synchrony, at equal speeds but opposite directions. Pressurised steam, (or any other working fluid), enters one side of the expansion chamber near the centre of the mechanism. This fluid exerts a pressure on the driving face 24 of one of the pistons, the pressure being at approximately normal to the plane containing the axis of rotation and the radius that passes through the piston face. In other words, the pressure is exerted at the near optimal orientation of the piston face, developing near maximum possible turning moment from the pressure. The raised portion 16 of the other, non-driving, rotary piston 10 forms an abutment. The pressure directed centrally is taken by the bearings on its shaft—without any expenditure of energy apart from frictional losses in the bearing as it turns. One rotary piston 54 is driving for half a turn, while the other 1 is driven, the situation is then reversed for the second half turn—and so on.

The mechanism is slightly similar to a single lobed gear pump operated in reverse as an engine. However, because a single lobe would not produce continuous rotation the motion is maintained by an external set of gears.

The two pistons 1 and 2 are of equal shape, unlike many other attempts at rotary piston mechanisms. For this reason the mechanism can be conveniently described, although not fully defined, as the "equal double rotary piston" mechanism. Fuller definition includes the raised portion of the rotary piston being a circular arc of nearly 180 degrees, fitting closely within the expansion chamber, as well as the two rotary pistons moving in close approximation as they rotate on parallel axles in opposite directions, synchronized by gears external to the expansion chamber.

Advantages of This Engine: There are many advantages of the equal double rotary piston engine and very few weaknesses. Overall it should be a far better engine than all current automotive engines.

1. The rotary pistons continually rotate in opposite directions thus functioning as flywheels and so conserving energy very efficiently. The complete absence of energy wastage via reciprocating or oscillating movement, even in minor components, (such as valves or abutments), is a major energy conserving factor.

2. There is a near 100% power stroke of the "cycle"—in contrast to the 25% power stroke of a four stroke internal combustion engine.

3. The resolution of forces in a reciprocating piston and crank means that the piston and con-rod act only very briefly in a near optimal orientation to produce rotation. (The optimal position is when the piston and con-rod apply all their forces in a straight line, and when this is also at right angles to the arm of the crank. This is approximated only briefly each cycle, but never fully satisfied in finite sized crank engines.) In contrast, the equal double rotary piston engine always applies force to the piston face is at nearly right angles to the rotating shaft, (depending on the slope of the gear profile), producing near optimal turning moment nearly 100% of the time. It is also vastly superior to the Wankel rotary mechanism.

4. Converting reciprocating motion into rotary motion via con-rods and crankshafts also creates friction as a reciprocating piston has components of forces directed against cylinder walls at changing angles. Such friction causing loss of power and efficiency is avoided in this particular rotary engine.

5. Also unlike a typical internal combustion engine there is no loss of power by induction, pre-ignition compression, and exhaust strokes. Driving of cams and valves is also eliminated. Such energy expenditure is often against springs operating in a non elastic manner, frequently involves reciprocation, and entails significant friction.

6. The two rotary pistons turn in opposite senses, clockwise and anticlockwise, ensuring that their acceleration imparts no net rotary inertial forces to the housing. This is an important advantage in automotive power plants where engine mountings are a significant part of the power to weight optimisation.

7. Both rotary pistons as well as the inlet cut-off valve are perfectly balanced and so produce no vibration at both high and low speed. This reduces the bulk of engine mounts, and improves power to weight engineering generally.

8. The mechanism is a positive displacement engine, not a turbine. This results in good acceleration from a stationary position against a load—as is required especially in typical automotive applications. Turbines are very poor in accelerating from a stationary position against a load. The "equal double rotary piston" mechanism is not an orbital engine, vane engine, or a Wankel engine—which despite being positive displacement rotary engines, all have one or more major problems especially in automotive applications.

9. With a constant direction of rotation and near constant angular velocity during a given cycle, there is very little friction and wear. Modern bearings, seals and timing gears have all been highly engineered over generations for great durability and performance and are easily utilised in this new setting.

10. The long curved surface of the raised portion of the rotary piston and the long distance in which it is in close proximity to the housing ensures that very little steam can leak between these surfaces, despite the absence of piston "rings". The two surfaces have their maximum length in close approximation when it is most needed, that is when the pressure is at a maximum—at the beginning of expansion. The flat faces of the rotary piston have seals which prevent steam escaping past the side of the raised portion of rotary piston and also from escaping through the main drive shaft bearings.

11. With modern accurate manufacturing techniques there will be a very small constant clearance between the two rotary pistons at the central point where there is tangential approach of the two rotary pistons. This allows a small amount of steam to escape between the rotary pistons at the central point. This steam is kept within the sealed system and exits with the exhaust steam, which is then condensed and re-used. This is the only weakness of the whole design. It is amply compensated for by the many advantages of this rotary engine over reciprocating and other rotary engines.

12. Both rotary pistons function as both piston face and abutment in one solid robust member. This important fact distinguishes the mechanism from the vast majority of other rotary piston mechanisms. Many other rotary piston designs have separate, often small, moving and therefore relative flimsy abutments. Spreading out the wear evenly over long and uniformly curved surfaces in close proximity to its adjacent surface distinguishes the mechanism from another common weakness of many other rotary piston designs. The balanced rotary inlet cut-off valve is also a very robust simple design with excellent durability.

13. Since it is an external combustion engine, burnt fuel residues do not enter the expansion chamber and produce contaminate or deposits—unlike internal combustion engines. Oil for bearings and synchronising gears is thus kept clean, resulting in low maintenance and improved longevity of the engine.

14. Properly controlled external combustion can produce less atmospheric pollution and allows a wide choice of many different fuels. Fuels used to produce steam may include traditional petroleum based fuels such as gasoline, kerosene or L.P.G. (Natural Gas). However these fossil fuels are contributing to net increases in atmospheric carbon dioxide, global warming and adverse climate change. More environmentally responsible fuels are being developed. These include renewable sources such as (second generation) ethanol, and algal oil. Less ideal fuels are first generation ethanol and vegetable oils such as canola. Hydrogen can be used as an external combustion fuel generated from a variety of intermittent energy sources such as wave, wind and solar power or constant sources such as geothermal energy. However the more direct combustion of second generation biofuels is a more direct, better, option than hydrogen.

15. Whatever the ultimate energy source the engine uses high pressure steam. For at least the last 30 years technology for rapid steam production in sufficient pressures and quantities for typical automotive use can be generated in about 45 seconds. Modern steam generators for automotive use are compact, light weight, safe and reliable. Regulation of steam for automotive use is also now very well established. Neither of these two areas of technology will be discussed in detail in this patent application.

16. The equal double rotary piston steam engine is simple, compact, with few moving parts and relatively inexpensive to manufacture. This is demonstrated by the fact that the prototypes of the rotary piston engine were produced in a backyard garage which had only a small lathe, a drill press, hand tools and air compressor. Even allowing for the cost of a steam generator, production costs would be cheap compared to those of internal combustion engines.

17. The suitability of a steam powered "equal double rotary piston" power plant to automotive applications is such that it would be possible to dispense with a clutch and gearbox, as some less efficient reciprocating piston steam vehicles have successfully done in the past. The weight saving of eliminating clutch and gear box would add to the power to weight efficiency of the power plant and reduce manufacturing and operating costs even further. It might be possible to eliminate other portions of the transmission train by having separate smaller equal double rotary piston engines directly driving each driven wheel. However this advantage would be offset by the need for relatively greater total thermal insulation of at least two engines, and by extra measures taken to protect the engines and pressure conduits from more proximity to road vibration.

Consequently we are of the opinion that this engine as described in the present patent application has the potential to make the four-stroke internal combustion engine obsolete in many situations. Automotive applications include heavy-duty long-distance road transport, light and commuter transport, as well as rail and marine transport, and possibly even air transport! (Regarding air-transport, the present engine and modern steam generators would be far more efficient than the very successful reciprocating piston steam engine propeller biplane of William and George Besler, flown in April 1933. The original newsreel is at www.youtube.com/watch?v=nw6NFmcnW-8.) Stationary applications include large scale electricity generation and small scale combined heat and electric power generation. Farmers could produce their own electric power using their own fuel as virtually any combustible fuel can be used in a furnace to produce steam. Portable units could also produce electricity or operate pumps for pneumatic or hydraulic equipment. Many tools, including compressed air machines often used in the mining industry, could be easily adapted to the "equal double rotary piston engine". Many other industrial processes could use steam powered equal double rotary piston power plants, making a more direct and hence efficient use of local energy sources.

SUMMARY OF THE INVENTION

There is an engine comprising: a fluid inlet; a fluid outlet; and a rotary valve downstream from the fluid inlet. The rotary valve includes a drum defining a rotation axis and a circumference, a first channel-structure configured to conduct fluid from the fluid inlet, a length of the first channel-structure, along the circumference, varying with the displacement of the drum along the rotation axis, and a second channel-structure configured to conduct fluid from the fluid inlet, the second channel-structure being connected in parallel with the first channel-structure, the second channel-structure being located such that the rotation axis is between the second channel-structure and the first channel-structure. The engine also includes a first rotary piston including a first abutment, the first abutment being configured to be driven by fluid from the rotary valve, and a second abutment, the second abutment being configured to drive fluid to the fluid outlet; and a second rotary piston including a first abutment, the first abutment being configured to be driven by fluid from the rotary valve, and a second abutment, the second abutment being configured to drive fluid to the fluid outlet, and to drive the first abutment of the first rotary piston.

The second abutment of the first rotary piston is configured to drive the first abutment of the first abutment of the second rotary piston, and the rotary valve is configured to rotate synchronously with the first rotary piston.

BRIEF DESCRIPTION OF THE DRAWINGS

References are made to the following text taken in connection with the accompanying drawings, in which.

DETAILED DESCRIPTION OF PREFERRED EMBODIMENTS

Figure 1:
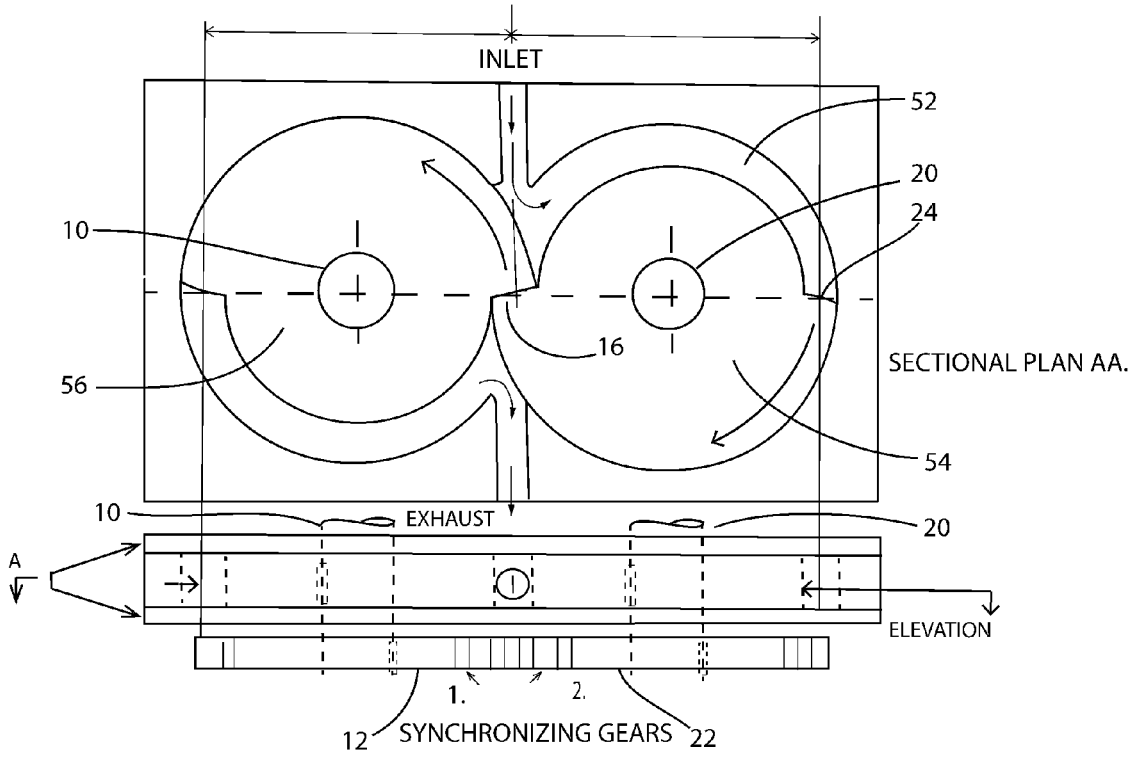
PRIOR ART Figure 1
FIG. 1 shows elevation and sectional elevation views of rotary pistons.

FIG. 1 shows elevation and sectional elevation views through the rotary pistons 54 and 56. It shows the engine at the transition from rotary piston 54 driving to the other piston 56 driving. An expansion chamber 52 is formed by the housing and the piston 54. The leading surface 24 of the elevated portion of rotary piston 54 has a suitable gear tooth profile shape, this curved face forming the piston face. The engine will always turn rotary piston 54 clockwise and rotary piston 56 anti-clockwise. The purpose of a gear tooth profile, (such as involute or other suitable curves), on the piston face is to minimise steam escaping during the brief transition from one part of the cycle to the next, because the small gap remains constant till they separate. The non-driving rotary piston 56 maintains an abutment 16 at the rear of the expansion chamber, against which steam pressure applies force to the leading end of the piston face which is in its driving cycle.

Rotary piston 54 will continue to drive till its trailing gear profile face completes its transition and the other rotary piston 56 becomes the driver. This will occur alternatively for each rotary piston after it turns 180°. Thus power is delivered alternatively for half the cycle by one rotary piston, then the other, so that the driver becomes the driven gear and the driven gear becomes the driving gear at each transition. What is said in respect of one rotary piston in any of the following figures, applies equally to the other rotary piston when it is in the equivalent position, bearing in mind that they turn in opposite directions. Despite there being two rotary pistons the engine should not be regarded as a twin cylinder engine, because one rotary piston will not work without the other.

The two rotary pistons are synchronised by gears on each rotary piston shaft. These gears have the same pitch circle diameters as the rotary pistons. That is they share the same mid-point diameter of the smaller and larger diameters of each rotary piston.

Following are brief descriptions of the various phases of the cycle, much of which is self-explanatory in the diagrams.

Figure 2:
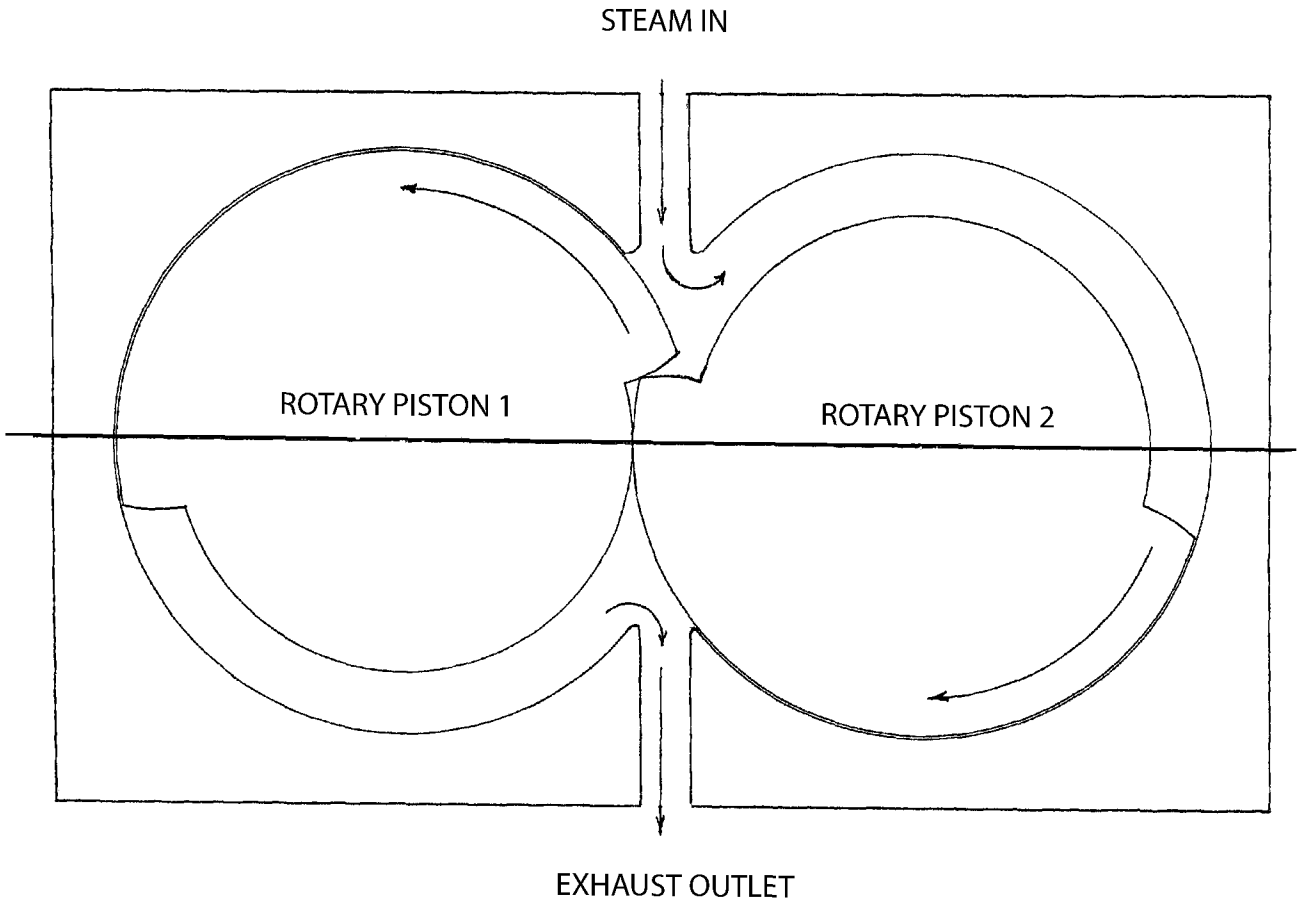
FIG. 2 shows that a rotary piston has just finished its power stroke and another rotary piston is about to start its power stroke.

In FIG. 2, rotary piston 54 has just finished its power stroke and rotary piston 56 is about to start its power stroke.

Figure 3:
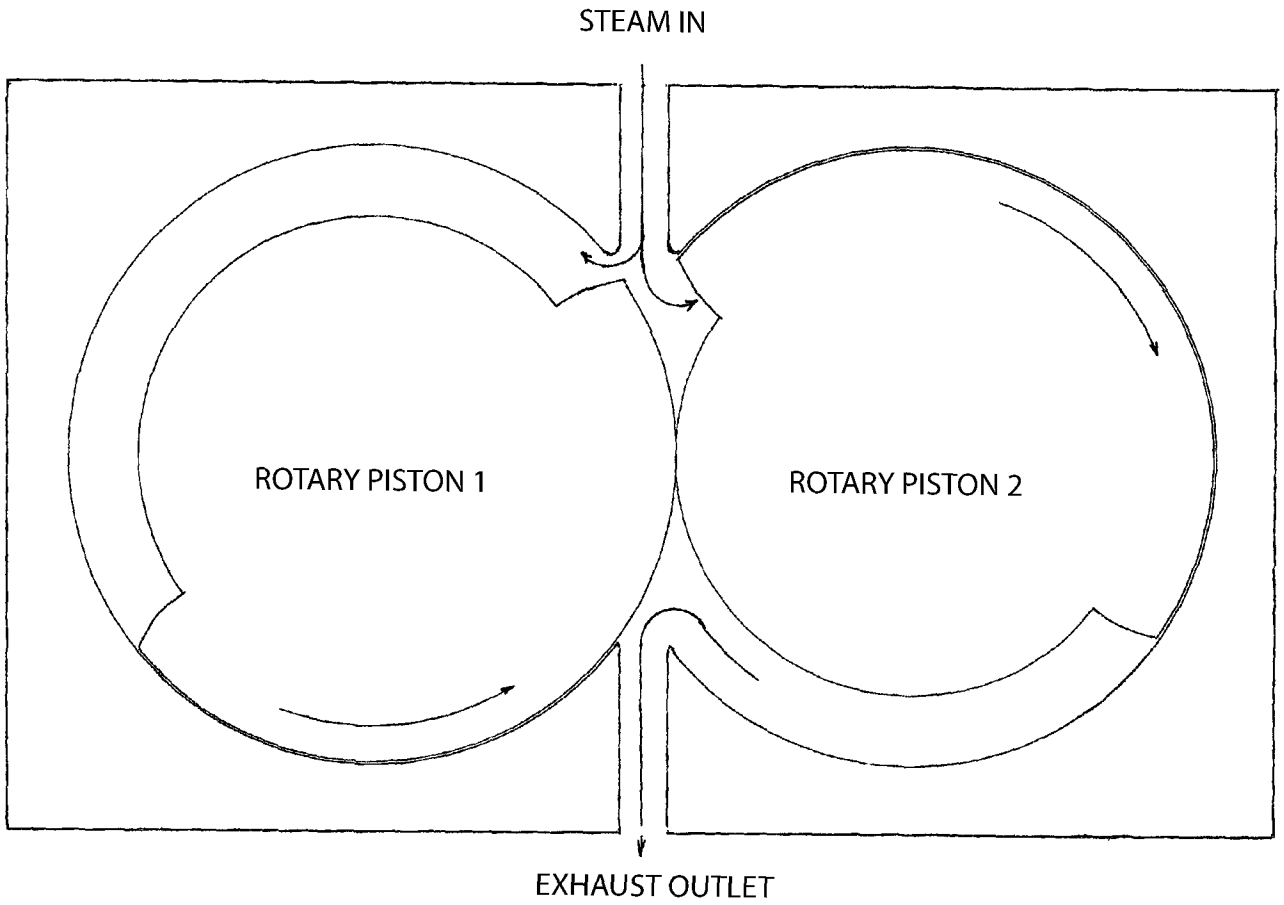
FIG. 3 shows an inward pressure on diameters produces no turning motion.

In FIG. 3, note that; a, inward pressure on diameters produces no turning motion and, b, there are three gear profile faces open to driving pressure—the force on the two faces of rotary piston 1 are balanced giving no net driving force, while the unbalanced forces on rotary piston 54 produce clockwise rotation of that piston.

Figure 4:
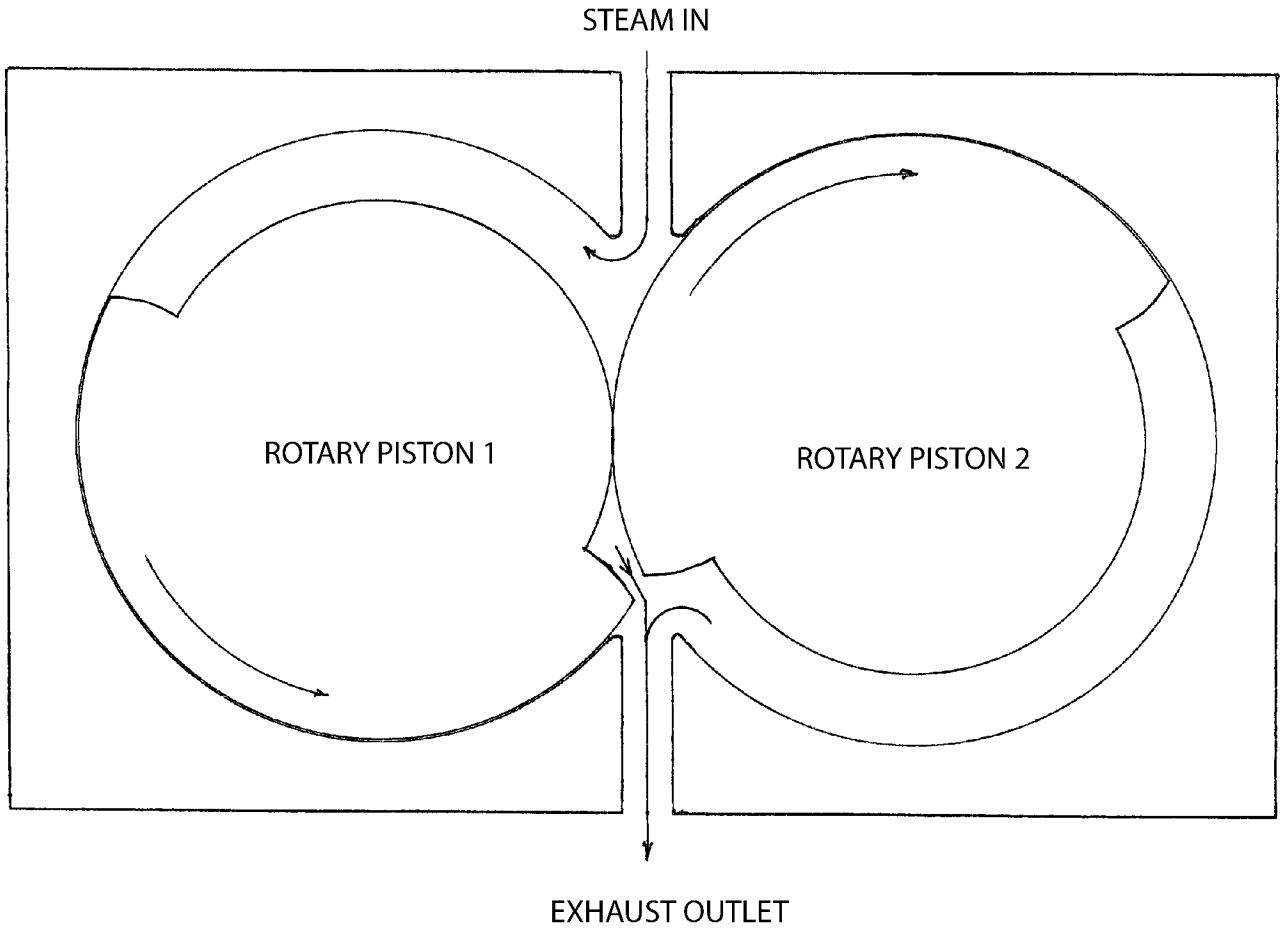
FIG. 4 shows a rotary piston that has passed the middle of its power stroke.

In FIG. 4, rotary piston 1 has passed the middle of its power stroke and has almost ceased exhausting its previous power stroke. Rotary piston 54 has started to exhaust.

Figure 5:
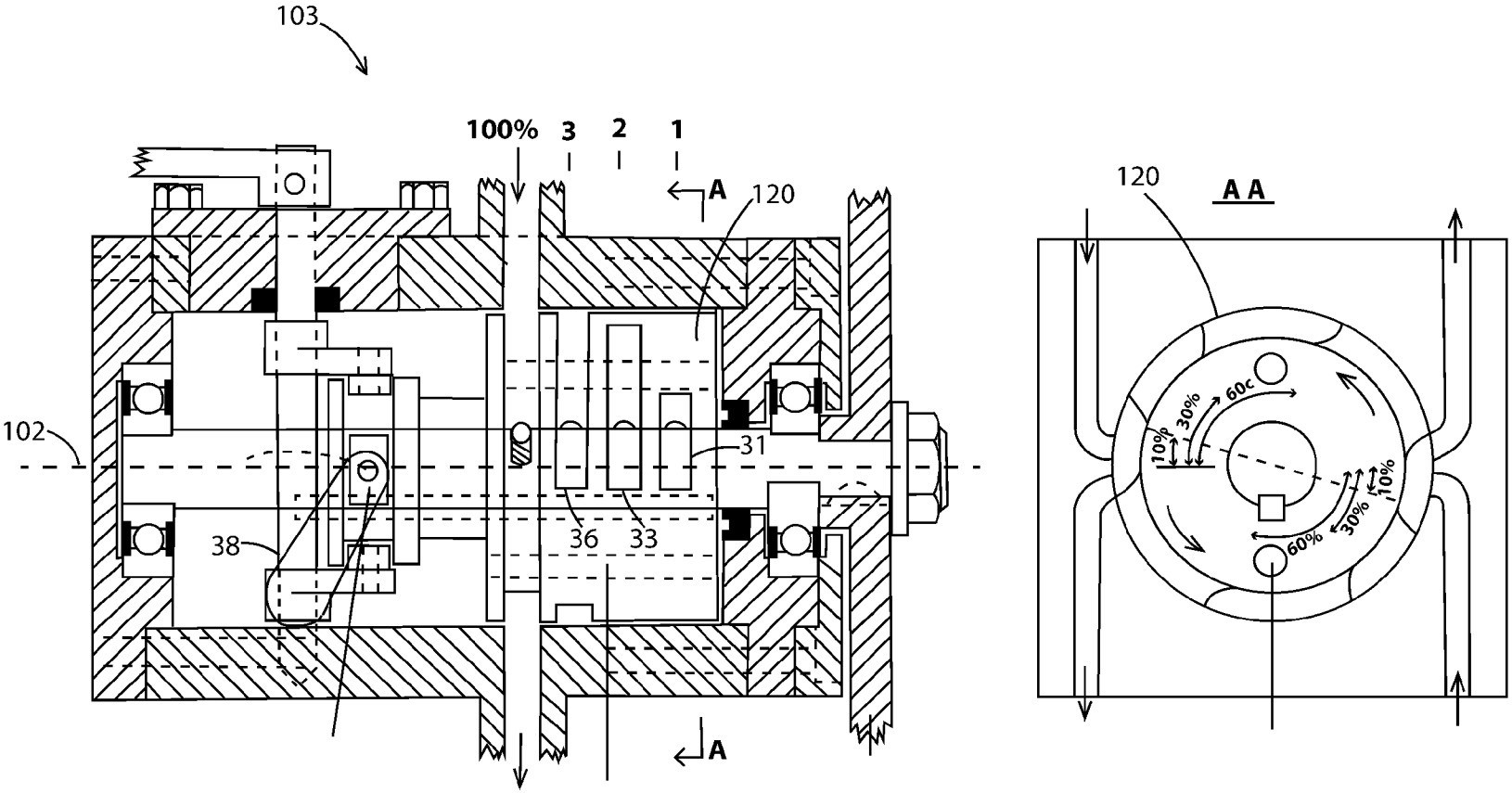
FIG. 5 shows a sectional view of a balanced variable inlet cut-off rotary valve.

FIG. 5 shows a sectional view of a balanced variable inlet cut-off rotary valve 103 in an example with four predetermined inlet cut-off settings, see pp. 9-12. Both the number of cut-offs, (not just four), and the cut-off ratios, can be chosen to suit specific applications.

Figure 6:
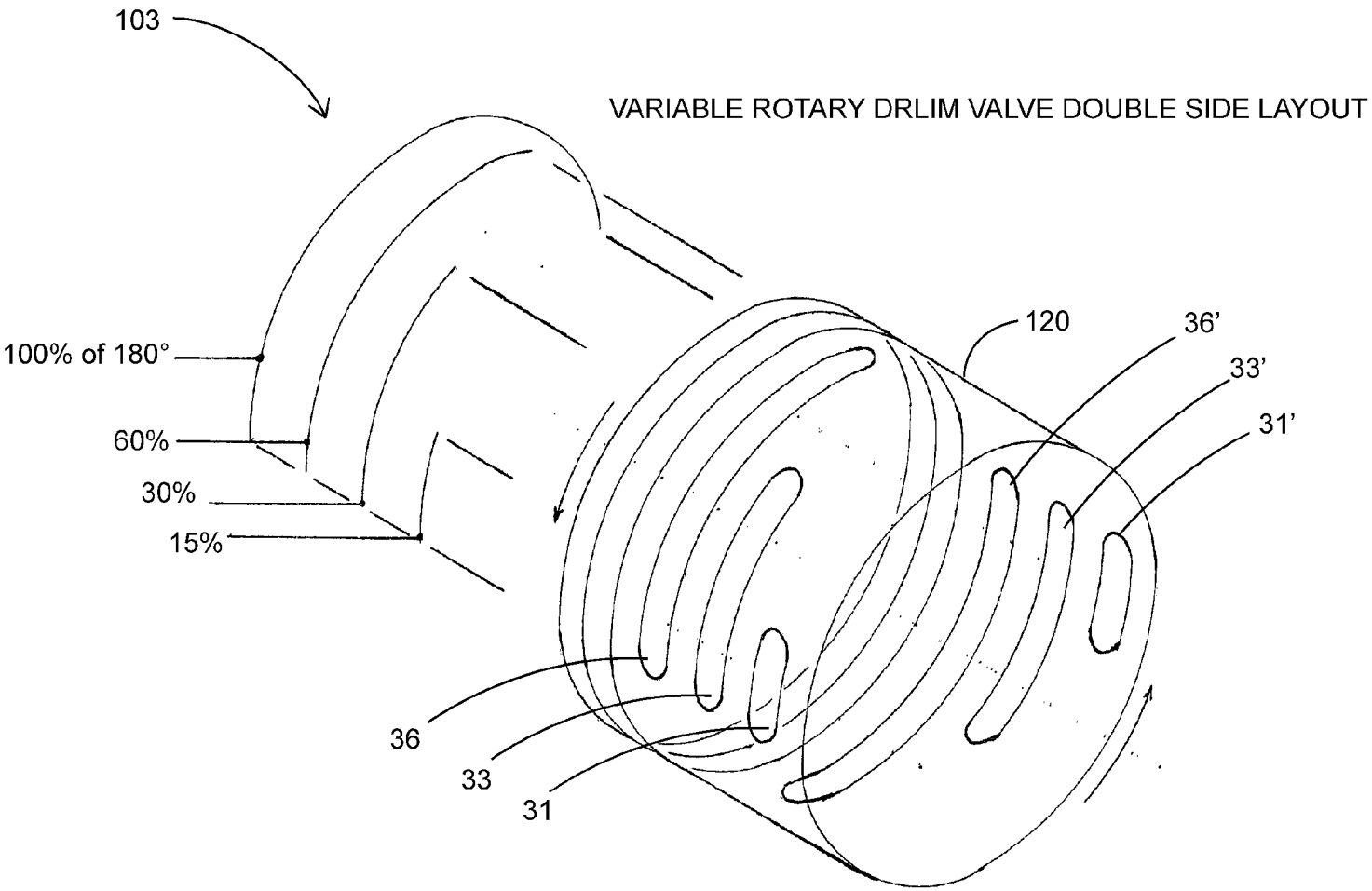
FIG. 6 is isometric figure illustrating the double sided nature of the balanced rotary valve.

FIG. 6 is an isometric figure illustrating the double sided nature of the balanced rotary valve 103. The full three dimensional nature of the solid cylinder with grooves formed is not illustrated, merely the outer edges of the grooves on the surface of the cylinder. Again a four cut-off setting is shown as an example.

Figure 7:
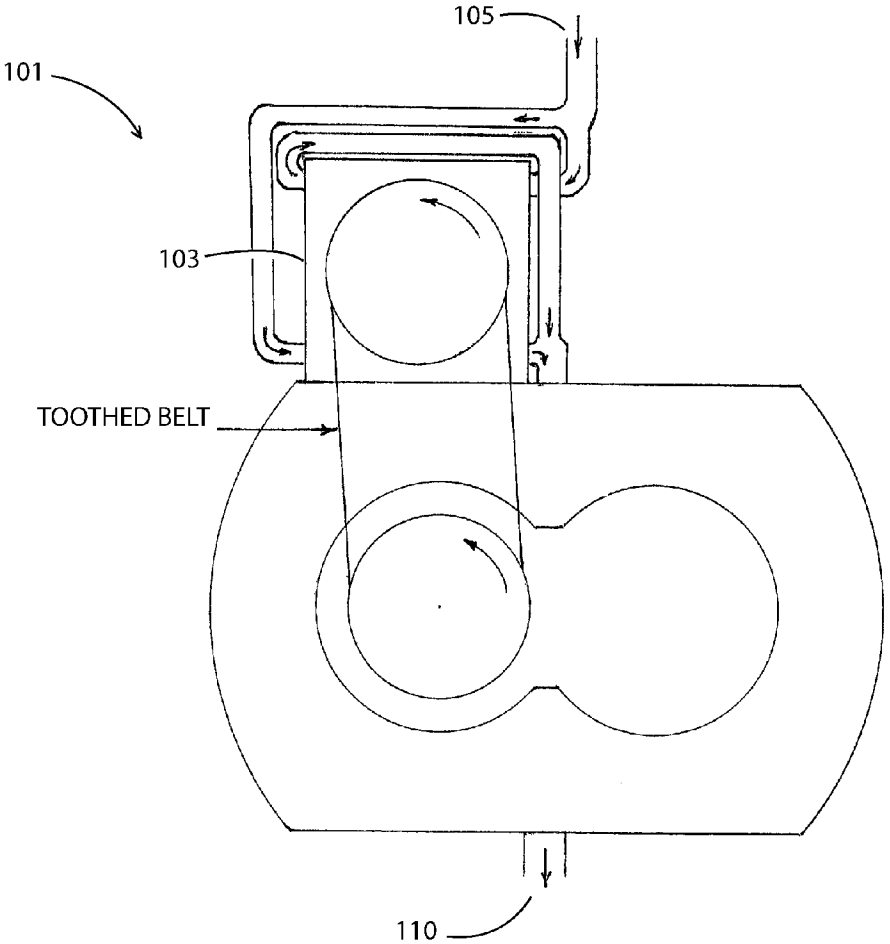
FIG. 7 shows an example of the rotary inlet cut-off valve in relation to an engine.

FIG. 7 shows an example of the rotary inlet cut-off valve 103 in relation to the engine 101. It illustrates an example with equal lengths of steam travel at all equivalent stages, from bisection of inlet 105 to inlet cut-off valve 103, through inlet cut-off valve itself 103, and exit from inlet cut-off valve 103 before merging and then entry into the expansion chamber. There is an outlet 110.

If a toothed timing belt it used to directly connect the main engine drive shaft and inlet cut-off, a similar geometry may be used. In simple pulley systems rotation takes place in the parallel planes—however other rotary transmission systems allow non parallel paths.

For example, one may use a system of bevel gears between the main engine drive shaft and the inlet cut-off valve shaft, allowing a closer approach of the inlet cut-off valve to the entry to the expansion chamber. The axis of rotation of the rotary valve 103 may be at right angles to the axes of the main drive shafts, passing through the central point, and in the plane of rotation of the rotary pistons. In this system the tow paths of steam have the same contour in the central region—an "S" shape, and a mirror image "S", with cut-off occurring at the centre of the "S" shape. This is not shown in the figures.

Figure 8:
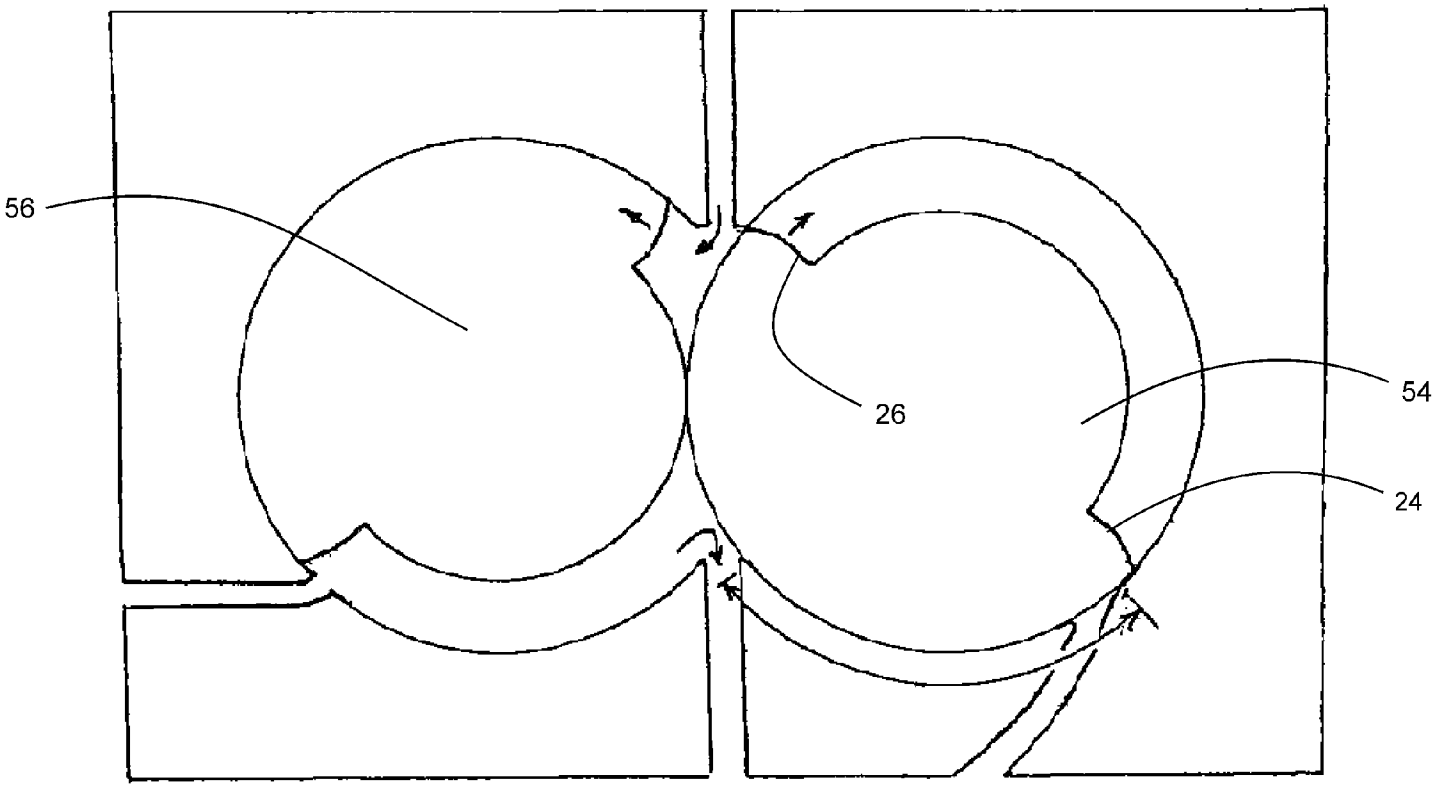
FIG. 8 shows two possible arrangements of early exhaust port for extraction of trapped steam for secondary use.

FIG. 8 shows two possible arrangements of early exhaust port for extraction of trapped steam for secondary use, see pp. 13-12. Secondary use may be either in a mechanically linked "compound engine", or in a non-mechanically linked "auxiliary engine". An auxiliary engine may be used to generate electricity or drive other ancillaries of automotive use etc. Note the aerodynamic path taken by the steam en-route to secondary expansion at a region equally favourable to steam routed from both rotary pistons, namely a midline region near the initial primary expansion exhaust.

Figure 9:
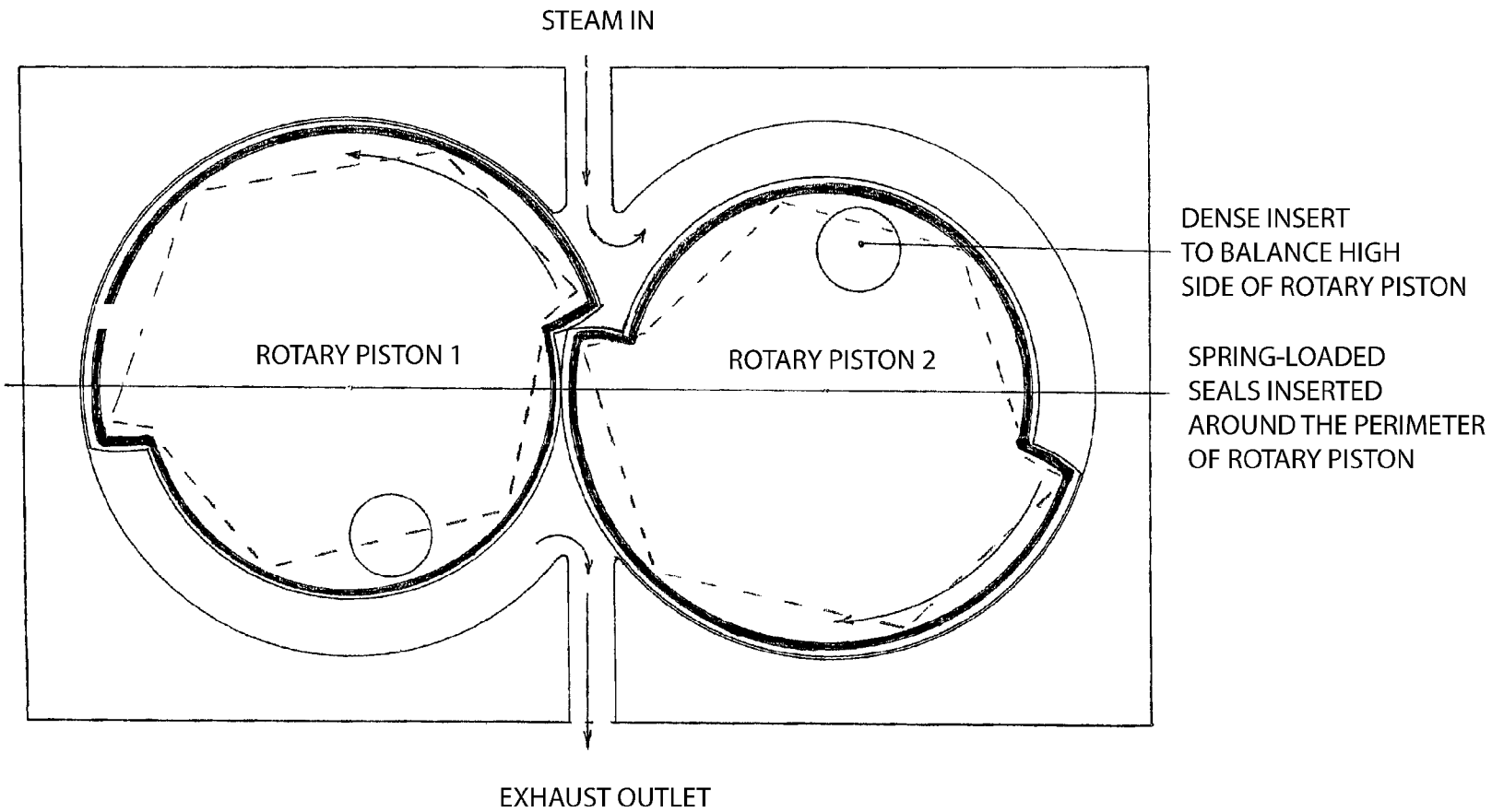
FIGS. 9, 10, and 11 show several ways to seal rotary pistons at their flat faces.
Figure 10:
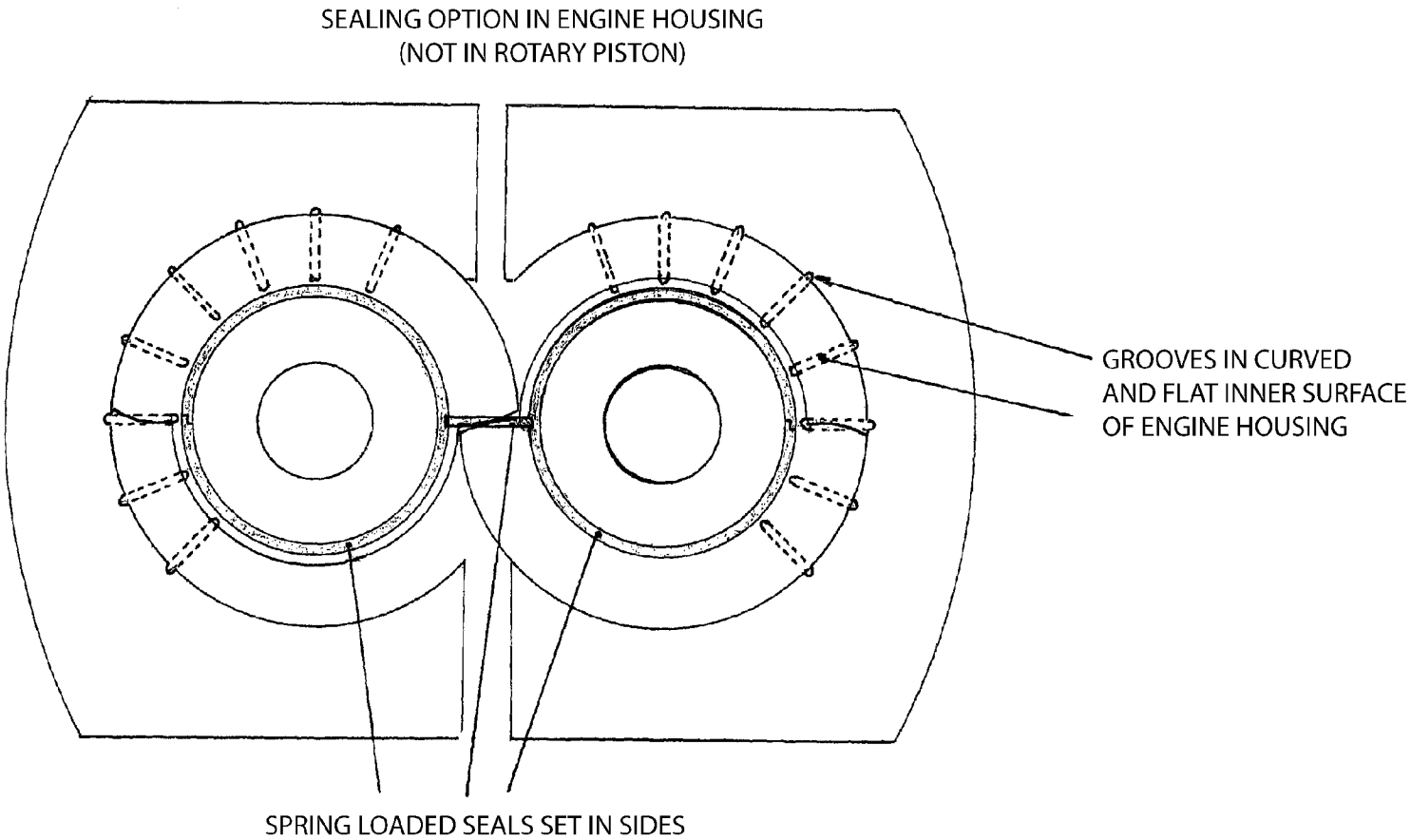
Figure 11:
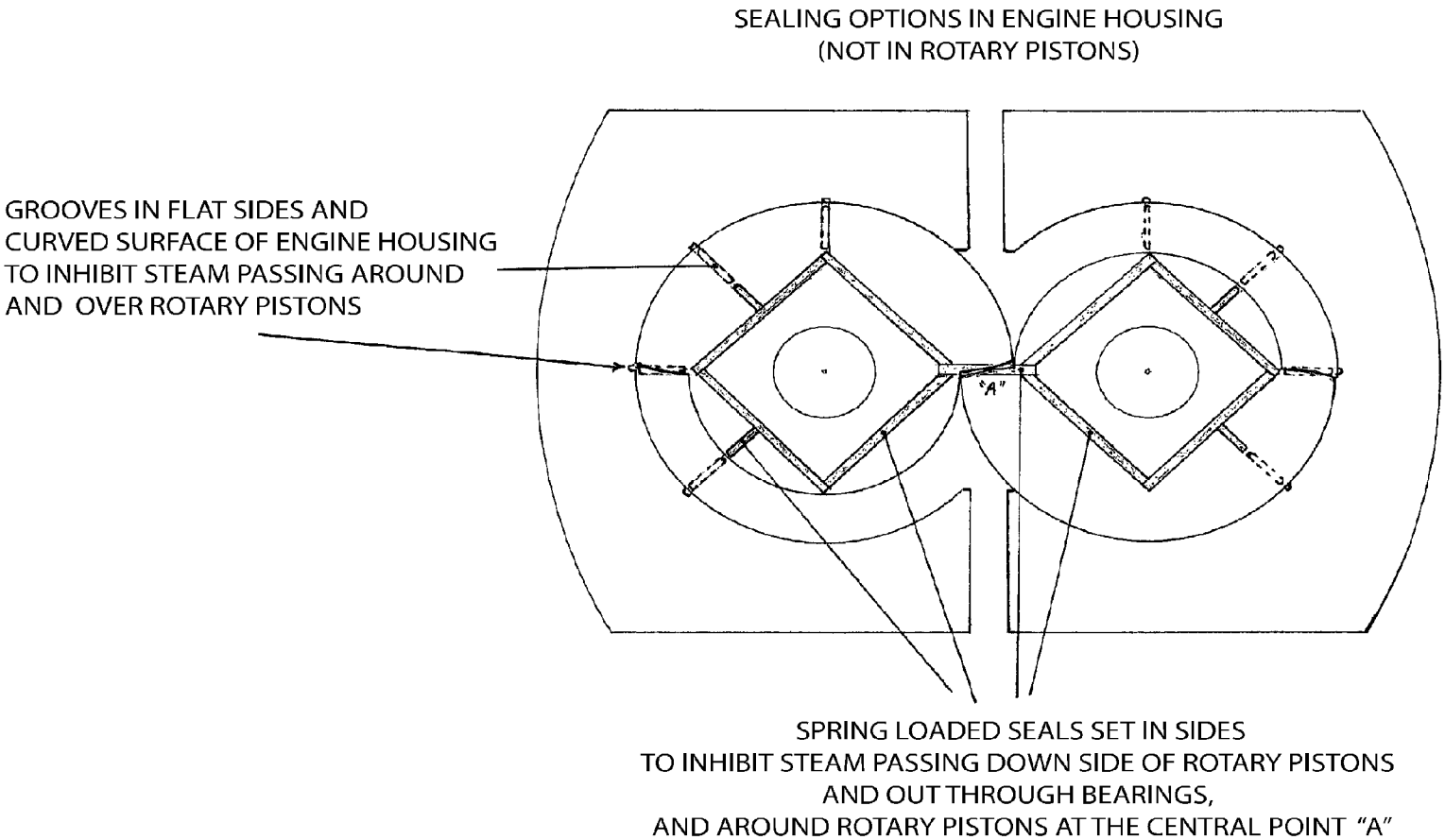

FIGS. 9, 10, and 11 show several ways to seal rotary pistons at their flat faces. These approaches are additional to those in our patent WO2006102696 (A1), published 2006 Nov. 16, priority AU20050201741 20050427.

The curved planar seal is fitted in a groove around the periphery of the flat surface of the rotary piston. The groove is deep enough to allow the seal to be well supported by the sides of the groove. At the base of the groove are recesses that fit springs of an appropriate number and positioning around the seal, such that suitable relatively evenly distributed pressure is exerted on the seal. The seals could be wider at the sharper corners to bear the extra stresses encountered at these regions—this last feature is not shown in FIG. 9. A series of straight seals or a single polygonal seal with straight segments may be used instead of a curved seal. The seal may be either an irregular or regular polygon and these straight segments may be replaced by shallow curves, with curvatures less than that given by an arc centred on the rotational centre of the piston at that point. The advantage of straight or slightly curved segments is that wear is distributed over a greater region of the flat surface of the rotary piston. Straight segments may be less expensive to manufacture. The dashed line of FIG. 9 shows an example of one possible arrangement of straight segments.

Counterbalancing weight or weights may be placed symmetrically within the non-raised half of the rotary piston so that the piston is statically balanced. The weight would be of a material denser than that of the bulk of the rotary piston, possibly tungsten or a lead alloy. In addition or alternatively, at least one hole may be formed symmetrically in the raised half of the rotary piston for the same purpose—(not illustrated on FIG. 9).

One may discuss at this point the balancing of the power plant as a whole. The primary expansion, balanced rotary variable inlet cut-off valve 103, secondary expansion, and ancillaries driven by secondary and primary expansion all rotate and ideally this rotation should be balanced, especially in acceleration. The core mechanism of primary expansion is inherently balanced, but the associated rotary transmission system driving the main load such as road wheels is not balanced. Likewise the "balanced" rotary variable inlet cut-off valve 103 is not balanced with respect to dynamic angular momentum—merely in the balancing of forces on its bearing, and static balancing. Similarly, any rotary ancillaries driven by the secondary expansion engine, such an electrical generator, are usually unbalanced during acceleration. The spatial arrangement of all these systems which accelerate together can be arranged such that net changes in angular momentum mostly cancel out. The component with greatest unbalanced angular momentum would be the drive train attached to the primary expansion—that is the driving wheels etc. This major source of in-balance during acceleration may be offset by arranging the sense and direction of rotation of the rotary inlet cut-off valve 103 and any ancillaries driven by a secondary expansion engine. A dual electric generator with clockwise and anti-clockwise rotors would be balanced, just as is the double equal rotary piston engine itself.

FIG. 10 illustrates more approaches to sealing. Firstly, circular seals may be set in grooves in the engine housing to prevent leakage of steam down the side of the flat surface of the rotary pistons, and into the main drive-shaft bearings. Secondly, improved sealing of the flat side of the housing at the central point may be effected by a second seal, broad enough such that the circumferential distance of suitable gear tooth profile is about the same as, or just less than, the breadth of the seal. This prevents the seal becoming unduly tilted during the passage of the two piston faces at the central point. Further improved sealing is via shallow grooves in the flat and curved surfaces of the expansion chamber. Steam enters these grooves and does no useful expansion. However turbulence on entering these grooves means further passage of steam through the small space between rotary piston and housing encounters more turbulence and resistance to leakage via that path. Whether this effect is beneficial and does not merely increase resistance with little reduced leakage, must to be decided empirically.

FIG. 11 is very similar to FIG. 10, except that straight, or at least less curved, segments are used for the seals as in FIG. 9.

Balanced Variable Inlet Cut-Off Rotary Valve.

See FIGS. 5, 6, 7 for a visual presentation of the basic concept. There is an absence of any form of inlet cut-off in nearly all prior art of steam powered equal double rotary piston engines. This was probably an important factor contributing to this exceptional mechanism not becoming widely used engine long ago. Prior art disclosing any form of rotary variable inlet cut-off for an equal double rotary piston engine is unknown to us. Furthermore, the proposed valve is balanced, both statically balanced, and balanced with regard to the pressure exerted by steam on the bearings of the rotary valve 103.

Typical automotive power plants have rapidly varying loads and widely varying speeds. It is indispensable to quickly and smoothly change between two, three, four, or more inlet cut-offs to use the most appropriate amount of steam to balance power and economy. This design is capable of rapid and smooth changing between potentially a large number of inlet cut-off settings. Consequently we believe it is especially suitable for automotive application. In some stationary situations, such as electrical power generation with its slowly varying loads, only one or two inlet cut-off settings may be required. The valve 103 is simple, easy to manufacture, effective, robust and durable. For these reasons we believe that this design and application to be novel and very useful.

The importance of inlet cut-off to allow fuller steam expansion was realised by steam engineers in the 1830's. Without any inlet cut-off a full head of steam can push a piston slowly against a large load, and at the end of the stroke exhaust steam may still be near full pressure. Exhausting high pressure steam is wasting energy.

A typical modern automotive steam generator can produce steam at least 20 times atmospheric pressure. Even in a fast engine operating against a small load it would be very inefficient to allow the steam to expand only 10 times in producing power before it exhausts to the atmosphere. One possibility would be doubling the length of primary expansion, but this is an inefficient way to extract the energy from steam already expanded 10 times—as most efficient energy transfer, or work is done early in expansion. A better way is cutting off the inlet steam part-way into the expansion, thus allowing a more full expansion than with full pressure steam being applied to the piston throughout the expansion. The rotary inlet cut-off valve 103 allows the steam to enter the rotary engine at the same position at the start of the "power stroke" of each rotary piston (ie. twice in 360° revolution) but cuts off the steam at approximately 10%, 30% or 60% of each power stroke, or it may allow the steam into the engine continuously for 100% of the cycle. Bear in mind that there are two rotary pistons in the engine. One drives for half one revolution (i.e. 180°), and then the other rotary piston drives for half one revolution. So in one 360° revolution of the engine each rotary piston in turn drives 180° while the other exhausts—giving a near continuous power stroke.

This "balanced variable inlet cut-off rotary valve" 103 was initially designed for use with the equal double rotary piston rotary steam engine to improve efficiency. However the valve 103 may also be used in other applications.

Operating Principle in an Example of Four Inlet Cut-Off Settings:

a. Consider for example a 10% "economy" setting. This allows steam into the engine for approximately 10% of the power stroke of each rotary piston, allows approximately 90% of the power stroke for the steam to expand and achieve near maximum energy efficiency. The time taken for opening and closing of the valve 103 would probably reduce the optimally efficient valve 103 operating time to about 85%.

b. A 30% setting allows steam into the engine for 20% more of the power stroke than a 10% setting, but it has also 20% less of the power stroke in which to expand before it completes the power stroke. This means that more steam has entered during the power stroke, but it has had less of the power stroke in which to expand and achieve its work potential. This gives more power at the expense of economy.

c. A 60% setting, for the same reason allows steam to enter for 50% more of the power stroke than the 10% setting—but is very wasteful of fuel. This would be best used only for short periods under extremely large load conditions such as climbing a steep hill.

d. In automotive settings, if a forward-neutral-reverse mechanical gearbox and clutch is used, then for a cold start the 100% setting would be selected allowing steam to enter the engine continuously for warming-up the engine quickly—while allowing the engine to rotate in neutral gear. Also when the engine is turned off, even if the engine is still hot, to restart the engine the drum valve 103 would need to be set in the 100% position for the engine to start, because in other settings the valve 103 may stop in a closed position.

Detailed Description of the Balanced Rotary Variable Inlet Cut-Off Valve (in a Four Cut-Off Setting Example)

The rotary valve 103 has a rotating cylinder on a shaft inside a sealed cylindrical bore housing. The inner cylinder turns at the same rate as the rotary pistons in the engine. This cylinder has a minimum of clearance with the bore with no metal-to-metal contact. The cylinder is keyed or splined to the shaft and can slide along it. It has a groove cut right around the circumference of the rotating cylinder (in the 100% setting), so that when this groove is aligned with the steam entry and exit ports in opposite sides of the cylinder bore, it does not inhibit the continual flow of steam through the valve 103.

The cylinder has three (or more) other grooves 31, 33, and 36 of different lengths around the circumference of the rotating drum 120 running parallel to the continuous (100%) groove and equally spaced along the drum 120. (Grooves 31, 33 and 36 constitute 3 channels each having an edge aligned in a line defined by the other edges.) The drum 120 may be moved along the bore so that the groove of choice may be aligned with the steam entry and exit ports. The start of each of these grooves are in-line, and are timed by a toothed-belt drive or gears in order to open when the engine rotary pistons pass the engine inlet port.

As indicated, the grooves are of different lengths; for example 10%, 30% or 60% of half the circumference of the drum 120. With respect to the grooves, the rotating drum 120 is double-sided. Equivalent grooves 31', 33', and 36' are formed in line with these grooves on the other side of the drum 120 so that in one revolution of the valve drum 120, two grooves of the same length will pass a given point. Consequently, in one complete rotation of the grooved cylinder, as the cylinder rotates and the start of the groove passes the entry port of the valve 103, it allows steam to pass through the groove and out the exit port of the valve 103 into the engine for the duration of the groove. When the rear end of the groove passes the entry port it cuts off the steam flow for the remainder of the half turn.

The same process happens simultaneously on the other side of the valve 103 because there are two sets of grooves on the drum 120 and an entry-exit port on both sides of the valve cylinder. This is repeated twice in one rotation of the valve 103 and engine. The steam supply line is divided to serve both valve inlets and the two exhausts unite before the steam enters the engine inlet port. Thus in one rotation of the valve cylinder, the steam enters and exits the valve twice for a short period depending on the cut-off ratio chosen.

2. Since the steam conduit is divided and enters the valve 103 at opposite sides, (and joins again before entering the engine), the force of steam pressing on one side of the rotating drum 120 is balanced by an equal force on the other side. This should result in long life of the rotary valve bearings. The valve drum 120 is neat fitting but does not touch the bore of the cylinder in which it turns. Thus there is no friction except in the bearings and seal, and little energy needed to drive it. This solves a friction and wear problem often associated with rotary valves, (especially rotary valves in internal combustion engines).

3. Since the incoming steam will move in the same direction that the rotating drum 120 turns, initial impact of steam pressure on the start of the groove acts like a turbine, assisting rotation of the drum 120. This could result in little, if any, effort being required by the timing device such as a toothed belt drive to turn the valve 103—assisting energy efficiency.

4. Since the rotating drum 120 does not touch the cylinder bore, there will be some leakage around the drum 120 and this will result in the interior of the valve 103 being pressurised, and in a small amount of steam continuing through into the engine when the valve 103 closes. This will not be a problem as the overall system is sealed, and the leakage of some steam into the engine will only contribute positively to driving the engine—smoothing out the pulse of inlet cut-off steam.

The purpose of the inlet cut-off valve 103 is to produce a "pulse" of steam for the duration of the valve 103 setting, even though it will not fully stop the flow of steam when the chosen groove closes. Unlike reciprocating engines in which a leaky valve results in energy complete lost, leakage past this inlet valve is merely a small amount of steam entering the cylinder without inlet cut-off, and is not wasted, although less efficient than steam used with inlet cut-off.

5. The valve 103 receives steam and operates only when the engine is in drive or warm-up mode. Movement of the drum 120 along the cylinder bore when choosing a different mode will not be inhibited because end-pressure caused by steam trapped at either end of the hollow cavity of the valve 103 housing will be equalised by vents through the rotating drum 120. Instead of the swinging arm selector 38 as indicated in FIG. 5, alternatively a rack and pinion may be used to move the yoke and slide the drum 120 along its shaft. Different types of bearings and seals may be used.

6. When changing cut-off settings, because the steam entry and exit ports of the valve 103 are wider than the division between the drum grooves 31, 33, 36, the next groove starts to open before the current one closes. Consequently there is no dead-spot between cut-off settings. Combination of two adjacent settings could in effect produce an intermediate setting between them—effecting a smoother change of effective cut-off. Changing of cut-off settings should be smooth enough to not require the use of a clutch.

7. Rather than a fixed number of discrete inlet cut-off settings, a continuously variable inlet cut-off may be accomplished by removing the partitions between the adjacent grooves, resulting in a pair of three-sided broad recesses on the surface of the cylinder. The corners of the pair of three sided shapes would touch at two of each triangle's corners if a continuous groove is included, i.e. in a 100% cut-off setting.

In this continuously variable valve pressurised steam would not be as effectively confined to the groove of the path as with discrete groove channels, but the fluid flow across the recess would still be predominantly in a 2 dimensional curve joining the inlet and outlet ports. This continuous cut-off valve would have increased turbulence compared to a valve 103 with a discrete number of grooves. However the advantages of continuously variable inlet cut-off may outweigh this disadvantage in practice.

The shape of the three sided recess may be a (straight edged) triangle wrapped around a cylinder for simplicity, but a curved edge, (or edges), could be designed to advantage. For example one, may compensate for the non-linear movement of the yoke with respect to the constantly varying arc through which the simply hinged actuating lever or handle is turned, as shown in FIG. 5. Alternatively, one could design suitable changes in variable cut-off that correspond to empirically determined typically useful changes in inlet cut-off during acceleration for the application for which the engine is designed.

8. This rotary inlet cut-off valve does not alter the mechanical advantage of the engine and transmission. However after optimisation of an automotive system, it may be decided empirically whether inlet cut-off will serve most of the purposes of a mechanical gearbox, or if it is better used in conjunction with a typical gearbox. In this later case, the variable inlet cut-off would serve mainly for energy efficiency not mechanical advantage.

Changing inlet cut-off alters the power and economy but not the ratio of engine to wheel revolutions. Since the engine is capable of very high revolutions it will usually need to be geared down, even if a typical variable ratio gearbox is not used. The ratio of gearing depends on the size of the road wheels, maximum speed of the car and power needed. This in turn determines the magnitude of the engine capacity, steam generator size, fuel supply, etc.

Secondary Expansion of Steam in an Equal Double Rotary Piston Engine the Problem of Back-Pressure.

Another important improvement in the equal double rotary piston engine relates to designing a second engine that uses the low pressure exhaust steam from primary expansion without imparting back-pressure onto the non-working faces of the pistons involved in the primary expansion. If one merely places the input to a secondary engine at the centrally located exhaust port of the primary expansion there will be a pressure build-up in the exhaust region of the primary expansion that exerts back-pressure on the non-working gear profile face of the rotary piston. Any energy gained by the secondary expansion would be at the expense of energy lost from the primary expansion. Note that with reciprocating steam engines one can simply use exhaust steam for secondary expansion because there is an exhaust valve that closes after primary expansion such that back-pressure cannot be exerted back into the primary expansion after this exhaust valve has closed. This is an outstanding problem to be solved with the equal double rotary piston mechanism, namely, to determine a simple means of including a secondary expansion of primary exhaust steam without imparting back-pressure to the primary expansion. Introducing a new separate exhaust valve on the primary expansion, as occurs in reciprocating engines would be one solution—but an inelegant solution involving several additional components, friction, possibly reciprocation losses and cost.

Solution to the Problem.

By careful reference to FIG. 8, one can observe that the raised portion of the rotary piston 54 has just closed off steam entering its half of the expansion chamber, and that rotary piston 56 has just begun its power stroke. The volume of partly expanded steam between the leading 24 face and trailing 26 face of rotary piston 54 is effectively sealed and remains constant for the rest of the rotation, almost a quarter of a turn—until the leading face 24 of rotary piston 54 passes the exhaust port. For this period the steam trapped in this cylinder cannot expand and does no work. It neither contributes to turning, nor does it hinder it. This is a feature that can be used to advantage. While this fixed cavity remains, irrespective of its position, its trapped steam can exit through an early exhaust port into secondary expansion. Once the leading face 24 of rotary piston 54 passes the usual central exhaust port, remaining steam will exhaust out through it and is not used.

The residual pressure in the central exhaust outlet of the primary expansion would be higher than the exhaust pressure of the secondary expansion. Ideally it would require two condenser systems. The condenser for the secondary exhaust would be designed to operate at a lower pressure than the condenser from residual primary exhaust. Merging a high pressure condenser system with a low pressure system would unhelpfully impart some back-pressure onto the lower pressure secondary expansion. However, since there would not be a great difference between the two exhaust systems one may merge the two exhaust systems after some initial separate condensation brings both pressures quite low, hence quite close, after which one may have a final combined condenser. Alternatively, once could rely on having such efficient and rapid condensation of an early merged single condenser that the negative pressure of efficient condensing simply draws in steam from both primary and secondary exhaust without putting significant back-pressure on either exhaust. The end result would be that combined extra power from both primary rotary pistons would supply steam to a secondary expansion for almost half of the primary expansion's cycle. This is a very considerable advantage in reclaiming of thermal energy into mechanical energy, energy that would otherwise be lost out an exhaust or into a condenser.

Expansion Engines: "Compound Engine" (Mechanically Linked) and "Auxiliary Engine" (Non-Mechanically Linked)

The steam available for secondary expansion could be routed to secondary expansion chamber similar to the primary expansion chamber that is mechanically linked to the primary expansion giving "compound expansion", or possibly to a separate "auxiliary engine" that is not mechanically linked to the primary expansion. A fixed mechanical link between primary and secondary expansion such that both expansions drive the final drive shaft involves choosing the best compromise ratio of primary and secondary expansion. However this optimal ratio varies with varying load since how much steam expands at a given speed of revolution depends on how much force it is working against. Any fixed ratio is necessarily a suboptimal compromise when there are greatly varying loads and speeds as is typically encountered in automotive applications. Varying the linking ratio via a highly variable gear box coupling primary and secondary expansion would be a feasible, but impractical approach. Therefore we believe, especially in an automotive setting, that a separate, auxiliary engine is possibly the best option. The separate auxiliary engine can be used to generate electricity to charge batteries for numerous ancillary uses in a fully developed automotive vehicle. Instead of the secondary expansion being performed by an equal double rotary piston engine, with or without inlet cut-off, one could use a turbine, a "Roots" blower, "gear pump" engine, or even reciprocating piston engine. However the many advantages of the equal double rotary piston engine make it the best option.

With an auxiliary engine, the placement of the inlet for secondary expansion must be in the plane midway between the two main drive shafts of the primary expansion. To take advantage of the inertia of the steam trapped between the raised portions of the rotary pistons one would route the exhaust destined for secondary expansion through an outlet substantially at a tangent to the primary expansion chamber at the predetermined point. A gradually expanding cross section of conduit assists forward movement of steam. The shallow angle of exhaust take-off, and aerodynamic contours towards the central plane described above necessarily favour a secondary expansion input near the exhaust port of the residual primary expansion. There could be a small deviation away from the plane of containing rotary pistons to allow both a residual primary exhaust separate from, yet adjacent to, the secondary expansion inlet. However it is probably more important to keep the inlet for secondary expansion less deviated, and preferentially deviate the path of the residual primary exhaust. The higher pressure, higher temperature residual primary exhaust could be used to steam jacket the secondary expansion or perform other energy regeneration processes for the secondary expansion.

With a dual (primary and secondary) expansion chamber system with two pairs of rotary piston operating out of phase, the pistons continually turn both main drive shafts. In this situation the optimal placement of the secondary expansion inlet would be between the two residual exhaust outlets, these outlets passing one on each side of the secondary inlet before merging.

Since the secondary expansion steam comes in two pulses per rotation of the primary expansion rotary pistons, the secondary expansion need not be merged into a single steam flow, but rather each pulse could be synchronised and routed to a secondary expansion inlet that is substantially tangential to the direction of steam flow that is optimal for inlets at each side of the secondary expansion rotary pistons respectively. The shorter the distance between the secondary expansion take-off and the secondary expansion inlets, the better. This implies that secondary expansion ought to have its inlet ports near the exhaust ports of the primary expansion. This also implies that, if the axels of the two expansion systems are parallel, as would be a compact and hence thermodynamically advantageous arrangement, then the secondary engine would be "upside down" (with respect to the primary expansion), and its direction of rotation the secondary expansion would be opposite to the primary expansion, (i.e. clockwise compared to anti-clockwise). This has advantages in minimising vibration, and reducing reactive forces due to changes in rotational inertia. Other secondary inlet placements with other orientations of multiple chambers can be generalized from the above examples by one skilled in the art.

Alternatively, with secondary expansion via a compound, (that is mechanically linked expansion), then all the primary exhausts destined for secondary expansion would also ideally take paths of equal lengths and shape before converging symmetrically at the inlet for the secondary expansion. The alternating nature of exhausts from each one of the pair of rotary pistons would allow a steady series pressure pulse inputs into the secondary expansion giving smooth operation, which as with the non-liked secondary expansion described previously, may be routed and synchronised to give optimal separate inputs to each of the secondary expansion inputs respectively.

With a compound engine each early exhaust may be routed separately and individually to the secondary expansion engine which would be generally mounted on the same drive shafts as the primary expansion. In this situation, the routes from early primary exhaust to secondary expansion inlet take the shortest possible aerodynamic paths, and it would be favourable to have the two engines mounted near each other and parallel. The phase relationship between the rotary pistons of primary and secondary expansion rotary pistons would ideally be such that the pulse of early exhaust arrives at the secondary expansion inlet at approximately the typical time for one of the secondary rotary pistons to arrive at the beginning of an expansion cycle. The optimal time may vary slightly as with all compound expansion depending on the load. In practice there would be only a slight difference in phase between the two engines as mostly steam travels very fast, except under extremely large loads.

If the primary and secondary expansions are mounted on the same pair of axles, then the radius of the rotary pistons would have to be the same, and so the increased volume of lower pressure steam for secondary expansion would have to be catered for by thicker disc-like rotary pistons, with pistons faces less square and more rectangular in relative cross section. There would be limits to the rectangular ratio of such narrow expansion chamber spaces in terms of efficient expansion due to fluid dynamics. Therefore one may consider secondary expansion in a compound engine that is mechanically linked by a gear train, not simply linked by being on the same axle. The secondary expansion's pair of axles could out-flank the primary expansion axles and engage with the primary axles via simple parallel gears, bearing in mind that odd numbers of gears in a gear train reverse the sense of rotation, (i.e clockwise to anticlockwise), and visa versa for even numbers of gear wheels in a gear train. Consequently entry into the secondary expansion may be at the "top" or "bottom" of the primary expansion depending on the number of gears in the gear train.

With secondary expansion in compound engines that are mechanically linked by having primary and secondary expansions on the same axels, there is a simple means of reducing wear on the external, synchronising gears and main axel bearings. Consider on FIG. 8, the pulse of steam destined for secondary expansion from the primary rotary piston 54. If this pulse of steam is routed to secondary expansion mounted on the same axel as rotary piston 54, then it would advantageous from a wear minimisation perspective, to have this pulse of steam timed such that the secondary expansion of rotary piston 54 is driving whilst primary expansion of rotary piston in non-driving. This can be accomplished by routing the secondary expansion steam from rotary piston 54 up towards the inlet region of primary expansion, and at the same time having the raised cam-like portion of secondary expansion rotary piston 54 being 180° out of phase with the raised cam-like portion of primary expansion rotary piston 54. Having the raised cam-like portions of primary and secondary expansion on opposite sides of the same axel would have some advantages in balancing, but complete balancing would still need balancing of both primary and secondary rotary pistons individually.

Similar principles can be applied if one chooses to route the secondary expansion steam from rotary piston 54 to an inlet for secondary expansion adjacent to the exhaust region of primary expansion. This may be for the purpose of having as short as possible path for steam destined secondary expansion before secondary expansion began. In order to keep the same clockwise rotation of rotary piston 54, the raised cam-like portion of the secondary expansion rotary piston 54 would be about 90° out of phase—as can be understood by careful consideration of FIG. 8.

Similarly arrangements in which the secondary expansion steam from rotary piston 54 (on the right in FIG. 5), crosses over to the side rotary piston 56 (on the left in FIG. 5), may be constructed by one skilled in the art. This may be for the purpose of minimising wear by evening out the driving forces on both rotary piston axles, and simultaneously minimising the length of steam conduit in routing to secondary expansion, and also by having as aerodynamically smooth conduits as possible.

There are many possible geometries allowing various secondary expansion rates and speeds, varying radii and cross sectional areas of secondary expansion piston faces, and varying positions of the secondary expansion axels, (generally parallel to, but not necessarily coplanar with the primary expansion axels). These variables may be optimised for the final application. In general, mechanically linked, i.e. compound secondary expansions, are best suited for relatively constant loads, or at least slowly varying loads, so that fine tuning of these variables for optimal energy performance can be achieved. Stationary engines, especially large electric power generation plants, (and possible large marine applications), rather than automotive land transport power plants, are probably the best setting for compound engines given their relatively slowly changing loads, and also given the irrelevance of the extra weight of the additional mechanisms in stationary engines. Justifying the extra complications for relatively small energy efficiencies is possible in large electric power generating plants because relatively small improvements of energy efficiency become significant savings due to the very large amounts of total energy conversion involved.

In summary, there is a balanced rotary variable inlet cut-off valve. The valve includes a cylinder rotating within a housing having two pairs of inlet and outlet ports, the cylinder having a plurality of pairs of grooves formed circumferentially around the cylinder, the plurality of grooves corresponding to the predetermined number of inlet cut-off settings that are to be used in a particular application, and the pattern of inlet and outlets alternating around the circumference. The classic water wheel or turbine like effect of steam entering the valve assists rotation of the cylinder in a constant direction.

The grooves are orientated in planes normal to the axis of rotation (102 in FIG. 5) of the cylinder, and the grooves extend a predetermined fraction of 180 degrees around the cylinder, the predetermined fraction being the same fraction as that desired for inlet cut-off of steam, an example being 50 percent inlet cut-off having two grooves in the same plane, each extending 90 degrees, and spaced evenly around the circumference of the cylinder of the rotary valve. Furthermore a single groove may be formed extending a full rotation around the cylinder of the rotary valve, wherein full steam pressure in applied continually to the expansion chamber.

The grooves and the leading edge of the recesses, are aligned so that the portion corresponding to the start of inlet cut-off are aligned substantially in a straight line.

The pairs of grooves, and the non circumferential edges of the recess, each have a shape that is aerodynamically curved to minimize turbulence in the high velocity high pressure steam on entry into, transit through, and exit out of the valve, the shape of the curve in a cross sectional plane. It is normal to the rotational axis of the cylinder, being two short curves of relatively small radii of curvature, not necessarily of the same curvature, meeting with one longer chord-like curve of relatively larger radius of curvature, all curves generally being circular arcs for simplicity of manufacture, but without excluding other suitable aerodynamic contours, the two short curves meeting with the surface of the cylinder at an angle substantially in line with the holes forming inlet and outlet ports, the angles of inlet and outlet generally, but not necessarily being equivalent, to the angle of the inlet and outlet ports as they pass through the housing. The shape of the grooves or recesses, in the cross section of a plane that includes the rotational axis of the cylinder, has the sides of the groove or recess exit the surface at an angle that is substantially normal to the surface of the cylinder, and having the base of the groove or recess connected to the side wails, preferentially in a aerodynamically smooth contour.

The number of distinct grooves have a plurality corresponding to the number of predetermined settings of inlet cut-off, for example, 100 percent, 50 percent, 20 percent and 10 percent in a four setting inlet cut-off valve. The pairs of such grooves are distributed evenly along the axis of rotation of the of the cylinder with approximately equal spacing between the grooves, allowing between each pair of grooves a suitable thickness of material for containing steam under pressure, and with a shoulder at each end of the cylinder broad enough to ensure stability of the cylinder on high-speed rotation inside the valve housing, whereby wear is evenly distributed and thus reduced.

The valve includes a cylinder rotating within a housing having two pairs of inlet and outlet ports, the cylinder having a single pair of equal three-sided recesses, rather than plurality of pairs of grooves, the recesses being formed on the cylinder's outer surface, one edge of the three-sided shaped recess being circumferential and the other two edges of this three sided shape corresponding to the inlet and outlet cut-off points when the edges of the recesses move past the inlet and outlet ports respectively. The pattern and orientation of the two outlets and two inlets alternates around the circumference, wherein also the water wheel or turbine like effect of steam entering the valve and encountering an edge of the recess assists rotation of the cylinder in a constant direction.

The rotary valve cylinder, is mounted coaxially on a sturdy rotating shaft such that;

a, it allows a close fitting but free longitudinal movement of the cylinder along the shaft, this being effected by mating shapes of the outer surface of the shaft and inner surface of the hole formed in the cylinder, such as is commonly accomplished through spines, keys and keyways, and cross sections of polygons both regular and irregular, with abutments and locking devices such as screws, pins and the like, such that the length of movement of the cylinder along the shaft may be adjustably secured, b, the shaft extends from at least one end of the cylinder, and generally at least one at each end, such extension being secured by rotary bearings, the inner portion of the bearing being secured near at least one end of the shaft, and the outer portion of this rotary bearing being secured to the valve housing, c, the shaft is turned at the same speed as the engine, the shaft being connected to the main drive shaft of the engine by a rotary transmission device such as gears, timing belts, especially notched belts and pulleys, timing chains, and the like, the shaft being turned at the same angular velocity as the main engine drive shaft, the rotary transmission device being connected to at least one of the main engine drive shafts, the advantage of notched timing belts and pulleys rather than timing chains and timing gears being that there is a very smooth action and adjustments in advancing and retarding timing may be easily accomplished via jockey pulleys and the like, and in the case of timing gears these may be connected to a separate set of spur gears, bevel gears, and the like, whereby closer approach of the rotary inlet valve and the main engine inlet may be accomplished by one skilled in the art, the second set of gears, or second portion of the main gears being mounted on the main drive shaft, rotating together but separate from the main engine synchronising gears, whereby uneven wear on the main engine synchronising gears is avoided, d, the moment of inertia of any additional rotating mass connected to one of the main engine drive shafts directly in the form of at least one separate portion of the main engine synchronising gear wheels, and via the rotary transmission device including the rotary valve itself, being balanced by the other main engine rotary piston and its synchronising gearwheel having appropriately increased and symmetrically distributed mass, whereby rotational acceleration occurs without unbalanced inertial reactions of the whole engine, and e, the rotary transmission device, has rotational adjustment of at least one its elements such that equal advancement or retardation of all the inlet cut-offs may be effected, examples of such rotary adjustment being those made by minor rotation of the rotary mechanism connected to the main engine synchronising shaft, this being able to turn slightly and being adjustably secured by grub screws, tapered screws and bolts, lock nuts, tapered keys, pins in a set of holes and the like, similar rotary adjustments being effected at the rotary transmission component secured to the shaft of the rotary valve, and means of changing the length of timing-belt or chain by the action of additional rotary components such as jockey pulleys and the like, by adjusting the placement of the valve housing with respect to the main engine, whereby advancing and retardation of inlet cut-off timing is effected.

The balanced rotary inlet cut-off valve includes a valve housing in the shape of a hollow cylinder with the ends securely sealed, with at least one end on the housing having a circular hole formed at its centre to allow the free but close fitting rotation of the shaft within the housing, the shaft protruding from the housing sufficiently to connect to the rotational transmission device and rotational adjustments. The valve housing is a hollow cylinder with internal diameter allowing free rotation with a close clearance with the grooved cylinder, or recessed cylinder, although strict steam tightness not being necessary, that function being performed by steam seals associated with protecting the bearings from high pressure steam, and with additional steam seals being situated at the outer boundary of the valve housing, at least one end of the usually closed ended cylinder housing being able to be removed and re-secured using bolts, screws and the like, positioning lugs and keys, gaskets and the processes usually associated with the sealing of pressure vessels of this nature commonly known to those skilled in the art, whereby the housing can be easily assembled and dissembled for manufacture, maintenance and repair.

Holes for inlet and outlet of steam are formed in the valve housing, with a predetermined relatively small distance separating the adjacent boundaries of each of the inlet and outlet ports, the predetermined distance being such that the material of manufacture does not deform under the steam pressure exerted, and such that the angles of entry and exit of inlet and outlet port into the valve housing are suitable for the material of manufacture, the angle of entry and exit of inlet and outlet ports lines, firstly being substantially within the plane that includes a pair of grooves, and secondly at an angle to the curved surface of the cylinder that minimizes turbulence, this later requirement favouring a shallow angle with a rounded edge, although not excluding other angles and other contours, the angle selected substantially matching the angle of the groove as the short curves exit the cylinder. The holes in the housing are of generally circular shape, and broad enough to extend at least over one groove and simultaneously over one partition between grooves, whereby sliding of the inlet and outlet cut-off ports relative to the cylinder performs a smooth transition from one cut-off setting to another with approximately equal cross section of steam conduit being available at all times.

The steam powered equal double rotary piston power plants may have a secondary expansion of steam whereby back-pressure from the inlet of secondary expansion does not impart back-pressure to the non-driving piston faces of the primary expansion, this being effected by placing two early exhaust ports in addition to the usual central midline positioned primary exhaust port, one early exhaust port being in each side of the primary expansion chamber, with one early exhaust for each rotary piston, through which early exhaust ports, steam is routed to secondary expansion.

a, The placement of the early exhaust is such that the opening of the port commences at a point around the periphery of the expansion chamber that is adjacent to the leading piston face of the non-driving rotary when the trailing face of the same non driving piston has just come into close proximity with the expansion chamber housing, thus trapping moderate pressure steam in between the leading and trailing faces of the non-driving rotary piston, the pressure of this steam being about the same as the steam after primary expansion at the region primary steam input, the moderate pressure steam then being vented into secondary expansion after it is no longer connected to the primary input region and before that trapped steam is exposed to the central primary exhaust.

b, The early exhaust ports being holes in the expansion chamber commence at the point, and extending a suitable small distance and with a suitable cross section that is able to vent most of the trapped steam at the moderate pressure within the time taken for about one quarter of a revolution of the main engine.

c, The early exhaust port holes preferentially are of an aerodynamic cross section and the holes entering the primary expansion chamber at an aerodynamic contour, generally being in the plane of the two rotary pistons, at least initially.

d, The early exhaust port hole enter at a shallow angle to the tangent of the circular shape of the primary expansion chamber, whereby the movement of the trapped steam is assisted.

e, The interface between the early exhaust port hole and the circular curve of the primary expansion chamber having an aerodynamically contoured leading and trailing edges suitable to the materials of manufacture and the forces involved.

f, The cross sectional surface area of the conduit towards secondary expansion is at least constant, not decreasing, and preferably very slightly increasing to assist in transfer of a large volume of moderate pressure steam.

g, The three dimensional shape of conduit to secondary expansion is an aerodynamic curve, in at least two dimensions, directed towards the region of the central primary exhaust, though not confluent with the primary exhaust, such that the early exhaust from both primary expansion rotary pistons is merged via conduits of equal length, whereby alternate pulses arrive at the inlet of secondary expansion.

h, The secondary expansion engine is a low to moderate pressure rotary engine, preferably an equal double rotary piston engine of suitable size, although not excluding other power plants such as turbines, "Roots" blowers in reverse and reciprocating engines.

i, the resulting secondary expansion being either an auxiliary engine, not linked mechanically to the primary expansion, whereby conflict between optimal compound expansion of both secondary and primary expansion with varying loads is avoided, the secondary expansion engine preferably driving electrical generator systems and other ancillaries; or, a compound engine, mechanically linked, in which primary drive systems are linked to secondary expansion by sharing the same drive shafts, or via another fixed or variable mechanical rotary transmission system.

In a mechanically linked compound expansion with each early exhaust being routed separately to the secondary expansion engine mounted on the same drive shafts as the primary expansion, the routes taken from early primary exhaust to secondary expansion inlet are the shortest possible aerodynamic paths, and the phase relationship between the rotary pistons of primary and secondary expansion rotary pistons being such that the pulse of early exhaust arrives at the secondary expansion inlet at approximately the typical time for one of the secondary rotary pistons to arrive at the beginning of an expansion cycle, and the raised cam-like portions of the primary and secondary rotary piston on the same axle having a suitable out of phase relationship, the phase relationship being that which has the driving force of primary expansion occurring as much as possible while the secondary rotary piston is non-driving, and visa-versa, thus minimising wear on the rotary pistons and associated synchronising gears and bearings, The exhaust from secondary expansion system may be condensed at least partially before being merged with steam from the residual primary expansion exhaust, thus reducing reflux from primary expansion exhaust into secondary expansion exhaust, although early merging of primary and secondary expansion exhausts and rapid condensation is not excluded.

Steam sealing of the flat surfaces of the expansion chamber of the steam powered equal double rotary piston engine, are substantially constituted by;

a, each rotary piston having two flat faces, each of these flat faces being fitted with a single curved flat seal fitted in a curved groove near the periphery of the flat surface of the rotary piston, the curve following each rotary piston's two semicircular arcs of greater and smaller radii and the two gear tooth profiles that form leading and trailing piston faces, the groove containing the seal being formed deep enough to allow the seal to be well supported by the sides of the groove, the base of the groove housing recesses that fit springs at an appropriate number and positioning around the seal such that suitable relatively evenly distributed pressure is exerted on the seal, the seal being wider and or deeper at the sharper corners thus withstanding the extra stresses encountered at these regions, b, each rotary piston having two flat faces, each of these flat faces being fitted with a set of straight seal segments or a single polygonal shaped seal, the seal being either an irregular or regular polygon, the straight segments alternatively being shallow curves, with curvature less than that given by an arc centred on the rotational centre of the piston at that point, whereby wear is distributed over a greater region of the flat surface of the rotary piston and long term steam sealing is improved, and ease of manufacture is assisted, c, four circular seals being set in grooves formed in each of the two flat parallel side surfaces of the expansion chamber engine housing, the seals being centred on the rational axis of each rotary piston, whereby leakage of steam down the side of the flat surface of the rotary pistons and into the main drive shaft bearings is reduced, d, two substantially straight seals in grooves formed in each of the flat parallel sides of the expansion chamber, the grooves and seals being orientated radially with respect to the axis of each rotary piston, and orientated on a plane including both axes of both rotary pistons, the breadth of the seal being at least wide enough to extend across the circumferential distance of the suitable gear tooth profile of the rotary pistons as they engage at the central point, the seal being broad enough to prevent it becoming unduly tilted during the passage of the two piston faces at the central point, whereby sealing of the flat side of the housing at the critical central point is improved, e, the seals, are combined with two circular seals being joined by a straight seal, the straight seal being at right angles to the tangent of circular seals, all components being in a flat plane, the region of joining being suitable contoured and the thickness at this join being suitable to withstand the extra forces imparted in operation of the combined seal, whereby more stability is imparted to the central seal by anchoring in with the circular seals, without excluding the use of separate straight and circular seals with separate spring loaded or keyed supports or the like.

The expansion chamber has shallow grooves formed in the flat and curved surfaces of the expansion chamber whereby pressurised steam enters these grooves and does not perform useful expansion, but rather results in reduced passage of steam through the small space between the rotary piston and housing as leaking steam encounters greater turbulence and hence encounters greater than usual resistance, the grooves on the curved portions of the expansion chamber being substantially parallel with the rotational axis of the main drive shafts and spaced at substantially regular intervals around the periphery of the expansion chamber, and the flat surfaces of the expansion chamber having similar grooves directed radially, or at least substantially at right angles to the axis of rotation of the main drive shaft and extending from a diameter a small distance less than the diameter of the smaller diameter of the rotary piston until the curved surface of the expansion chamber, the grooves on the flat surface generally intersecting with the grooves on the curved surface of the expansion chamber, any sealing of the main shaft bearing by additional seals having a suitable clearance with the grooves.

The elements of primary expansion, balanced rotary variable inlet cut-off valve, secondary expansion, and ancillaries driven by secondary and primary expansion are arranged and orientated spatially such that the sense of rotation, clockwise or anticlockwise, of the primary expansion and the associated rotary transmission system driving the main load such as road wheels in an automotive application, is constructed to be in the opposite sense of rotation and on a substantially parallel axis to the balanced rotary variable inlet cut-off valve and any rotary ancillaries driven by the secondary expansion engine, such as electrical generators, whereby during acceleration net changes in angular momentum of the drive train attached to primary expansion is balanced by net changes in angular momentum of a combination of the balanced rotary inlet cut-off valve and the ancillaries driven by a secondary expansion engine if one is used, the net changes in angular momentum within the core mechanism of the primary and secondary expansion being necessarily zero due to the balanced geometry of the mechanism as a whole and individual rotary pistons, or via other types of balancing as customary to one skilled in the art.

The invention claimed is:

1. An engine comprising:

a fluid inlet;

a fluid outlet;

a rotary valve downstream from the fluid inlet, the rotary valve including a drum defining a rotation axis and a circumference, a first channel-structure configured to conduct fluid from the fluid inlet, a length of the first channel-structure, along the circumference, varying with the displacement of the drum along the rotation axis, and a second channel-structure configured to conduct fluid from the fluid inlet, the second channel-structure being connected in parallel with the first channel-structure, the second channel-structure being located such that the rotation axis is between the second channel-structure and the first channel-structure;

a first rotary piston including a first abutment, the first abutment being configured to be driven by fluid from the rotary valve, and a second abutment, the second abutment being configured to drive fluid to the fluid outlet; and a second rotary piston including a first abutment, the first abutment being configured to be driven by fluid from the rotary valve, and a second abutment, the second abutment being configured to drive fluid to the fluid outlet, and to drive the first abutment of the first rotary piston, wherein the second abutment of the first rotary piston is configured to drive the first abutment of the second rotary piston, wherein the rotary valve is configured to rotate synchronously with the first rotary piston.

2. The engine of claim 1 wherein the first channel-structure includes a first plurality of channels formed circumferentially around the drum, the first plurality of channels corresponding to a predetermined number of inlet cut-off settings; and the second channel-structure includes a second plurality of channels formed circumferentially around the drum, the second plurality of channels corresponding to the predetermined number of inlet cut-off settings.

3. The engine of claim 2 wherein the first plurality of channels includes 5 channels each having an edge aligned in a line defined by the other edges.

4. The engine of claim 2 wherein the first plurality of channel are distributed evenly along the rotation axis of the drum with approximately equal spacing between the channels.

5. The engine of claim 1 wherein the drum defines a channel extending a full rotation around the drum thereby enabling full pressure to be applied continually to the fluid outlet.

6. The engine of claim 1 wherein the drum is mounted to enable longitudinal movement of the drum.

7. The engine of claim 1 further including a housing defining holes for inlet and outlet of fluid.

8. The engine of claim 1 further including a housing, the first rotary piston defining an expansion chamber having shallow grooves formed in flat and curved surfaces of the expansion chamber whereby pressurised steam enters the grooves and results in reduced passage of steam through a space between the first rotary piston and the housing.

9. The engine of claim 1 the first rotary piston includes a counterbalancing weight, the weight being more dense than that of a bulk of the first rotary piston.

10. An engine according to claim 1 wherein the fluid inlet is a gas inlet.

11. An engine according to claim 1 wherein the fluid inlet is a steam inlet.

* * * * *